US011139576B2

(12) United States Patent
Lee et al.

(10) Patent No.: US 11,139,576 B2
(45) Date of Patent: Oct. 5, 2021

(54) PLANAR MULTIPOLE ANTENNA

(71) Applicant: CHUNG ANG UNIVERSITY INDUSTRY ACADEMIC COOPERATION FOUNDATION, Seoul (KR)

(72) Inventors: Han Lim Lee, Seoul (KR); Ye Bon Kim, Seoul (KR); Hyun Jun Dong, Seongnam-si (KR); Young-Jun Kim, Suwon-si (KR)

(73) Assignee: CHUNG ANG UNIVERSITY INDUSTRY ACADEMIC COOPERATION FOUNDATION, Seoul (KR)

( * ) Notice: Subject to any disclaimer, the term of this patent is extended or adjusted under 35 U.S.C. 154(b) by 18 days.

(21) Appl. No.: 16/839,572

(22) Filed: Apr. 3, 2020

(65) Prior Publication Data

US 2020/0321702 A1 Oct. 8, 2020

(30) Foreign Application Priority Data

Apr. 3, 2019 (KR) ..... 10-2019-0039026

(51) Int. Cl.
*H01Q 1/36* (2006.01)
*H01Q 9/28* (2006.01)
(Continued)

(52) U.S. Cl.
CPC ..... *H01Q 9/285* (2013.01); *H01Q 1/48* (2013.01); *H01Q 21/062* (2013.01); *H01Q 25/002* (2013.01)

(58) Field of Classification Search
CPC ..... H01Q 9/285; H01Q 25/002; H01Q 1/48; H01Q 21/062; H01Q 21/065; H01Q 19/005; H01Q 21/08
(Continued)

(56) References Cited

U.S. PATENT DOCUMENTS 4,816,835 A * 3/1989 Abiko ..... H01Q 21/0075 343/700 MS
5,300,936 A * 4/1994 Izadian ..... H01Q 1/32 343/700 MS
(Continued)

FOREIGN PATENT DOCUMENTS

JP 6490319 B1 3/2019
KR 10-0420489 B1 3/2004
(Continued)

OTHER PUBLICATIONS

Chun-Mei Liu et al. "Wide-Angle Scanning Low Profile Phased Array Antenna Based on a Novel Magnetic Dipole" IEEE Transactions on Antennas and Propagation, vol. 65, No. 3, Mar. 2017, p. 1151-1162.

*Primary Examiner* — Jean B Jeanglaude

(74) *Attorney, Agent, or Firm* — Novick, Kim & Lee, PLLC; Sang Ho Lee

(57) ABSTRACT

Provided is a planar multipole antenna, and more particularly, to a planar multipole antenna which is capable of adjusting a beam width and a band characteristic and reducing the size. The planar multipole antenna includes a plurality of radiators formed above a conductor plate, the plurality of radiator includes a main radiator and a plurality of additional radiators, the main radiator includes a signal applying hole to which a signal is applied, and the additional radiator is connected to a ground formed on the conductor plate.

10 Claims, 26 Drawing Sheets

(51) Int. Cl.
*H01Q 25/00* (2006.01)
*H01Q 1/48* (2006.01)
*H01Q 21/06* (2006.01)

(58) Field of Classification Search
USPC ..... 343/700
See application file for complete search history.

(56) References Cited

U.S. PATENT DOCUMENTS

| | | | | |
|---|---|---|---|---|
| 6,225,958 | B1 * | 5/2001 | Amano | H01Q 5/00 343/767 |
| 8,432,314 | B2 * | 4/2013 | Mao | H01Q 1/523 343/700 MS |
| 9,112,276 | B2 * | 8/2015 | Desclos | H01Q 1/1207 |
| 9,373,886 | B2 * | 6/2016 | Kitchener | H01Q 19/108 |
| 2009/0135066 | A1 * | 5/2009 | Raappana | H01Q 5/371 343/700 MS |
| 2011/0095958 | A1 * | 4/2011 | Mao | H01Q 13/206 343/860 |
| 2013/0285877 | A1 * | 10/2013 | Desclos | H01Q 5/371 343/872 |
| 2018/0145420 | A1 * | 5/2018 | Kushta | H01Q 15/0026 |

FOREIGN PATENT DOCUMENTS

| | | | |
|---|---|---|---|
| KR | 10-2011-0035722 | A | 4/2011 |
| KR | 10-1948443 | B1 | 2/2019 |

* cited by examiner

PLANAR MULTIPOLE ANTENNA

CROSS-REFERENCE TO RELATED APPLICATIONS

This application claims the priority to Korean Patent Application No. 10-2019-0039026 filed on Apr. 10, 2019, in the Korean Intellectual Property Office, the disclosure of which is incorporated herein by reference.

BACKGROUND

Field

The present disclosure relates to a planar multipole antenna, and more particularly, to a planar multipole antenna which is capable of adjusting a beam width and a band characteristic and reducing the size.

Description of the Related Art

A patch-type antenna which is being most widely used has advantages in that it is easy to manufacture and has a high gain, but a range (half power beam width: HPBW) in which a beam is radiated so that a gain is dropped to 3 dB is approximately ±40 degrees. Further, a range in which the gain is 0 dB is approximately ±60 degrees so that a shadow range is generated in a range of ±90 degrees from a planar reflector.

SUMMARY

In order to efficiently design an array antenna system which is capable of forming (or scanning) a beam with a wide range, a single antennal element with a small size having a large beam width while maintaining a high gain is necessary.

Due to the limited characteristic of a beam created by one field source, when a magnetic current which may flow in various directions is induced around a radiator to which a signal is applied and an electric field which changes a resonance frequency is induced to create an additional beam with a wider range, a beam control characteristic may be more flexible.

The present disclosure has been made to solve the above-described problems and an object of the present disclosure is to provide a planar multipole antenna with a reduced volume which has a larger beam width, is capable of controlling a band characteristic, and configuring a beam pattern. In the meantime, in the present disclosure, a volume of the antenna aimed to reduce the size may include a ground plane and an antenna height.

Technical objects of the present disclosure are not limited to the aforementioned technical objects and other technical objects which are not mentioned will be apparently appreciated by those skilled in the art from the following description.

According to an aspect of the present disclosure, a planar multipole antenna includes a plurality of radiators formed above a conductor plate, the plurality of radiator includes a main radiator and a plurality of additional radiators, the main radiator includes a signal applying hole to which a signal is applied, and the additional radiator is connected to a ground formed on the conductor plate.

The main radiator of the planar multipole antenna according to the exemplary embodiment of the present disclosure forms a plurality of magnetic dipoles or electric dipoles, and the additional radiators may induce the plurality of magnetic dipoles or electric dipoles by the main radiator.

In the planar multipole antenna according to the exemplary embodiment of the present disclosure at least one of the main radiator and the plurality of additional radiators may include a plurality of via holes.

In the planar multipole antenna according to the exemplary embodiment of the present disclosure, the plurality of via holes is formed in a line.

In the planar multipole antenna according to the exemplary embodiment of the present disclosure, the plurality of via holes is formed at one end of the radiator.

According to the exemplary embodiment of the present disclosure, when the plurality of radiators forms a plurality of columns in the first direction, the plurality of via holes is formed in a line in the second direction.

According to the exemplary embodiment of the present disclosure, when the plurality of radiators forms a plurality of columns in the second direction, the plurality of via holes included in a radiator disposed in at least any one column is formed in a line in the first direction.

According to the exemplary embodiment of the present disclosure, when a single radiator is disposed in the first direction, a plurality of via holes included in the single radiator is formed in a line in the first direction.

According to the exemplary embodiment of the present disclosure, when a single radiator is disposed in the second direction, a plurality of via holes included in the single radiator is formed in a line in the second direction.

In the planar multipole antenna according to the exemplary embodiment of the present disclosure, in a position of the plurality of radiators disposed on the conductor plate, a distance from one surface of a radiator located at one end in the first direction to the other surface of a radiator located at the other end in the first direction is 0.5λ (half wavelength) or less, and a distance from one surface of a radiator located at one end in the second direction to the other surface of a radiator located at the other end in the second direction is 0.5λ (half wavelength) or less.

According to the present disclosure, a beamwidth of a single antenna may be increased and a size of the single antenna may be reduced as compared with a patch antenna of the related art.

That is, a larger beamwidth may be formed for all planes in a small ground size as compared with structures of the related art.

Further, even though a ground size is increased, in the antenna of the related art, the beamwidth is increased only on one plane. However, according to the planar multipole antenna structure according to the present disclosure, when the ground size is increased, beamwidths of all planes are increased.

Accordingly, the planar multipole antenna according to the exemplary embodiment of the present disclosure may configure a three-dimensional beam forming antenna which does not generate a shadow region.

Further, according to the present disclosure, an impedance band characteristic (bandwidth and multiband) may be adjusted by tuning an additional element and a shape of a beam to be formed may be formed in a single antenna in accordance with an element arrangement (a distribution structure).

Moreover, according to the present disclosure, abeam to be formed may be formed in accordance with a configuration of vias connected to an element.

The effects of the present invention are not limited to the technical effects mentioned above, and other effects which are not mentioned can be clearly understood by those skilled in the art from the following description.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
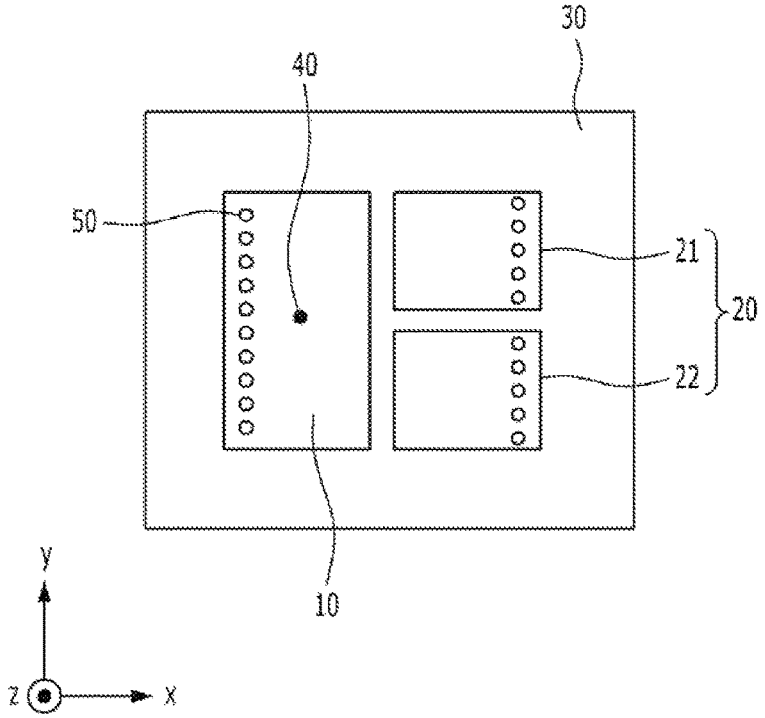
FIG. 1 illustrates a structure of a planar multipole antenna according to an exemplary embodiment of the present disclosure.

Those skilled in the art may make various modifications to the present invention and the present invention may have various embodiments thereof, and thus specific embodiments will be described in detail with reference to the drawings. However, this does not limit the present invention within specific exemplary embodiments, and it should be understood that the present invention covers all the modifications, equivalents and replacements within the spirit and technical scope of the present invention. In the description of respective drawings, similar reference numerals designate similar elements.

Terms such as first, second, A, or B may be used to describe various components but the components are not limited by the above terms. The above terms are used only to discriminate one component from the other component. For example, without departing from the scope of the present invention, a first component may be referred to as a second component, and similarly, a second component may be referred to as a first component. A term of and/or includes combination of a plurality of related elements or any one of the plurality of related elements.

It should be understood that, when it is described that an element is "coupled" or "connected" to another element, the element may be directly coupled or directly connected to the other element or coupled or connected to the other element through a third element. In contrast, when it is described that an element is "directly coupled" or "directly connected" to another element, it should be understood that no element is not present therebetween.

Terms used in the present application are used only to describe a specific exemplary embodiment, but are not intended to limit the present invention. A singular form may include a plural form if there is no clearly opposite meaning in the context. In the present application, it should be understood that term "include" or "have" indicates that a feature, a number, a step, an operation, a component, a part or the combination thoseof described in the specification is present, but do not exclude a possibility of presence or addition of one or more other features, numbers, steps, operations, components, parts or combinations, in advance.

If it is not contrarily defined, all terms used herein including technological or scientific terms have the same meaning as those generally understood by a person with ordinary skill in the art. Terms defined in generally used dictionary shall be construed that they have meanings matching those in the context of a related art, and shall not be construed in ideal or excessively formal meanings unless they are clearly defined in the present application.

In the specification and the claim, unless explicitly described to the contrary, the word "comprise" and variations such as "comprises" or "comprising", will be understood to imply the inclusion of stated elements but not the exclusion of any other elements.

Hereinafter, exemplary embodiments according to the present invention will be described in detail with reference to accompanying drawings.

FIG. 1 illustrates a structure of a planar multipole antenna according to an exemplary embodiment of the present disclosure.

Referring to FIG. 1, a planar multipole antenna according to the present disclosure includes one main radiator 10 and a plurality of additional radiators 20 which are formed above a conductor plate 30.

The main radiator 10 is applied with a signal through a signal applying hole 40 to form a magnetic dipole or an electric dipole and the additional radiators 20 are disposed in the vicinity of the main radiator 10 to form additional extra poles.

In the meantime, in the overall specification, individual radiators may be referred to as elements.

Figure 3:
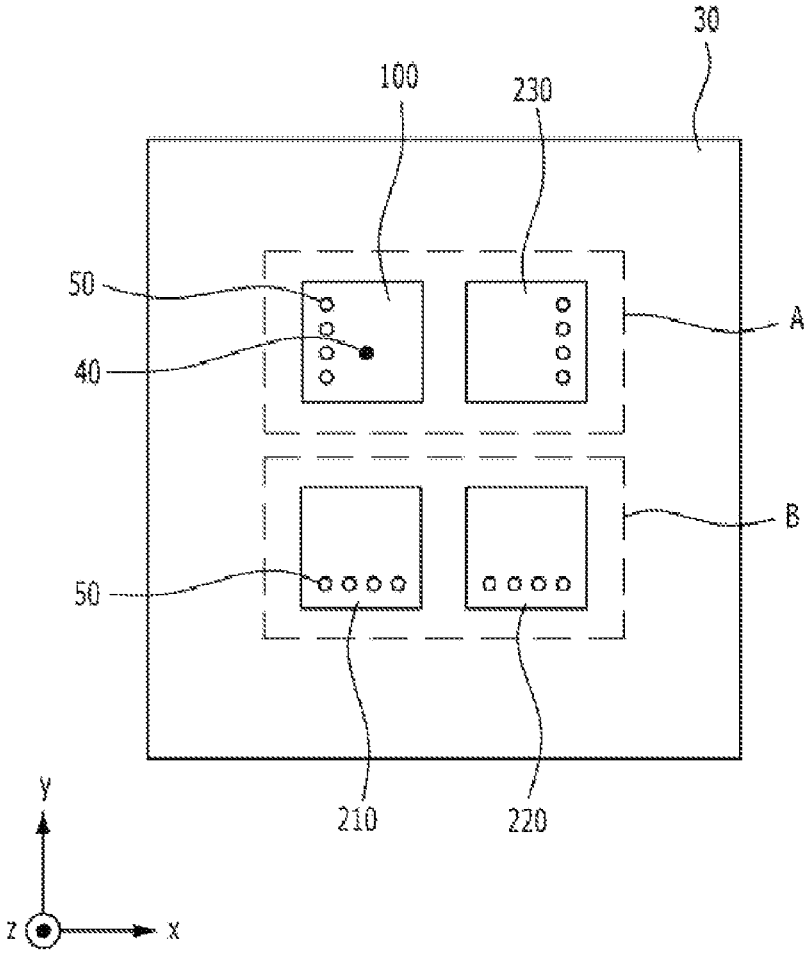
FIG. 3 illustrates a structure of a planar multipole antenna according to another exemplary embodiment of the present disclosure.
Figure 4:
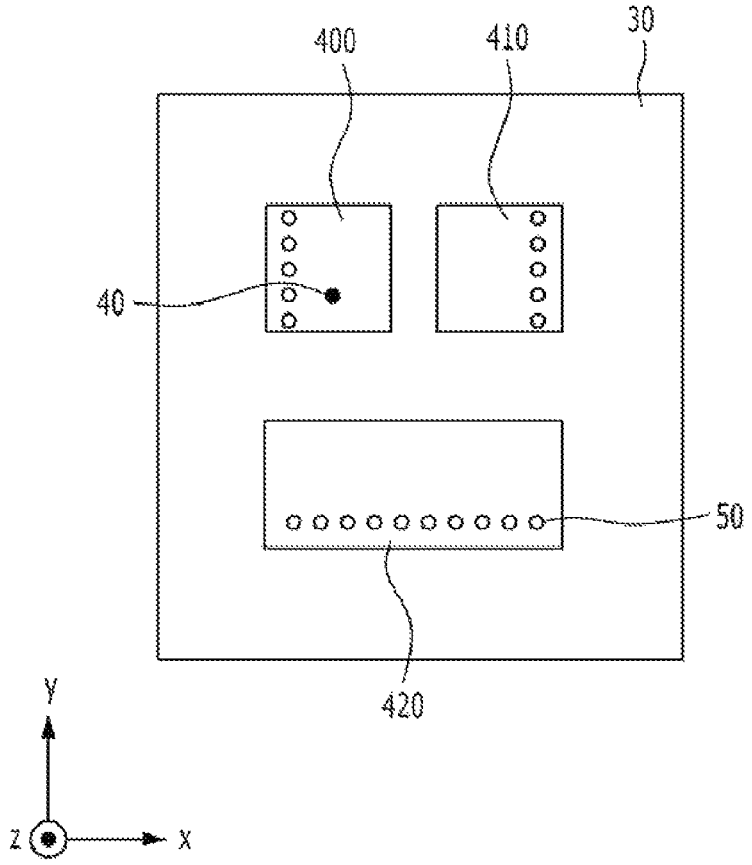
FIG. 4 illustrates a structure of a planar multipole antenna according to still another exemplary embodiment of the present disclosure.

Distribution of the plurality of radiators is not limited to a structure illustrated in FIG. 1, but may be formed with various structures as illustrated in FIGS. 3 to 5.

The number of radiators to be distributed may be determined depending on a desired shape of beam and a bandwidth characteristic. The more the number of elements, the higher the flexibility of beam pattern configuration. Therefore, when the number of elements and a size of the element are individually adjusted, the bandwidth and the beam pattern configuration may be freely designed.

Figure 2:
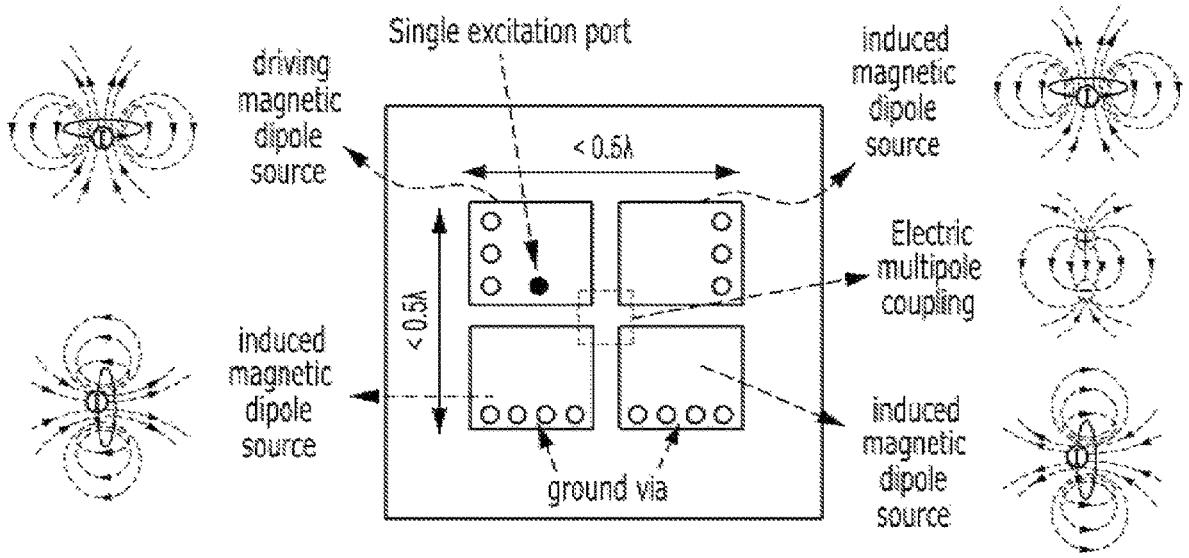
FIG. 2 illustrates an operating principle of a planar multipole antenna according to an exemplary embodiment of the present disclosure.

FIG. 2 illustrates an operating principle of a planar multipole antenna according to an exemplary embodiment of the present disclosure.

An antenna according to an exemplary embodiment of the present disclosure is a planar antenna structure and when a signal is applied to the main radiator 10, an additional magnetic dipole is induced to the additional radiator 20 to operate as an antenna.

The additional radiator 20 is connected to a ground formed on the conductor plate through a plurality of via holes formed in the additional radiator 20.

In the meantime, as illustrated in FIGS. 1 and 2, the plurality of via holes is formed in a line and is disposed at one end of the radiator. According to the present disclosure, a conductor which does not have a via is added to additionally form a magnetic dipole.

FIG. 3 illustrates a structure of a planar multipole antenna according to another exemplary embodiment of the present disclosure.

A planar multipole antenna illustrated in FIG. 3 is configured to include one main radiator 100 and three additional radiators 210, 220, and 230 disposed in the vicinity of the main radiator.

Referring to FIG. 3, when the plurality of radiators forms a plurality of columns A and B in a second direction (a y direction), a plurality of via holes 50 included in a radiator disposed in at least any one column B may be formed in a line in a first direction (an x direction).

FIG. 4 illustrates a structure of a planar multipole antenna according to still another exemplary embodiment of the present disclosure.

Referring to FIG. 4, when a single radiator 420 is disposed in the first direction (an x direction), a plurality of via holes 50 included in the single radiator 420 is formed in a line in the first direction (an x direction).

FIGS. 5A to 5L illustrate a structure and a size of a planar multipole antenna according to various exemplary embodiments of the present disclosure.

The planar multipole antenna according to the present disclosure may reduce a size of a radiator structure to be half wavelength (0.5λ) or less. Here, the wavelength λ refers to a free space wavelength.

In order to reduce sizes of all radiators, additional radiators are shorted to the ground in consideration of a direction of the current so that according to the present disclosure, a size of the multipole radiator is smaller than a normal patch antenna or is not larger than the normal patch antenna.

Referring to FIGS. 5A to 5L, a size of the radiator structure is formed such that in positions of the plurality of radiators disposed on the conductor plate, a distance from one surface a of a radiator located at one end of the first direction (x direction) to the other surface a' of a radiator located at the other end of the first direction is 0.5λ (half wavelength) or less. Further, a distance from one surface b of a radiator located at one end of the second direction (y direction) to the other surface b' located at the other end of the second direction may be 0.5λ (half wavelength) or less.

That is, when the planar multipole antenna according to the present disclosure is used, it is easy to manufacture an antenna which has a reduced size and has a better performance than the antenna of the related art.

Figure 6:
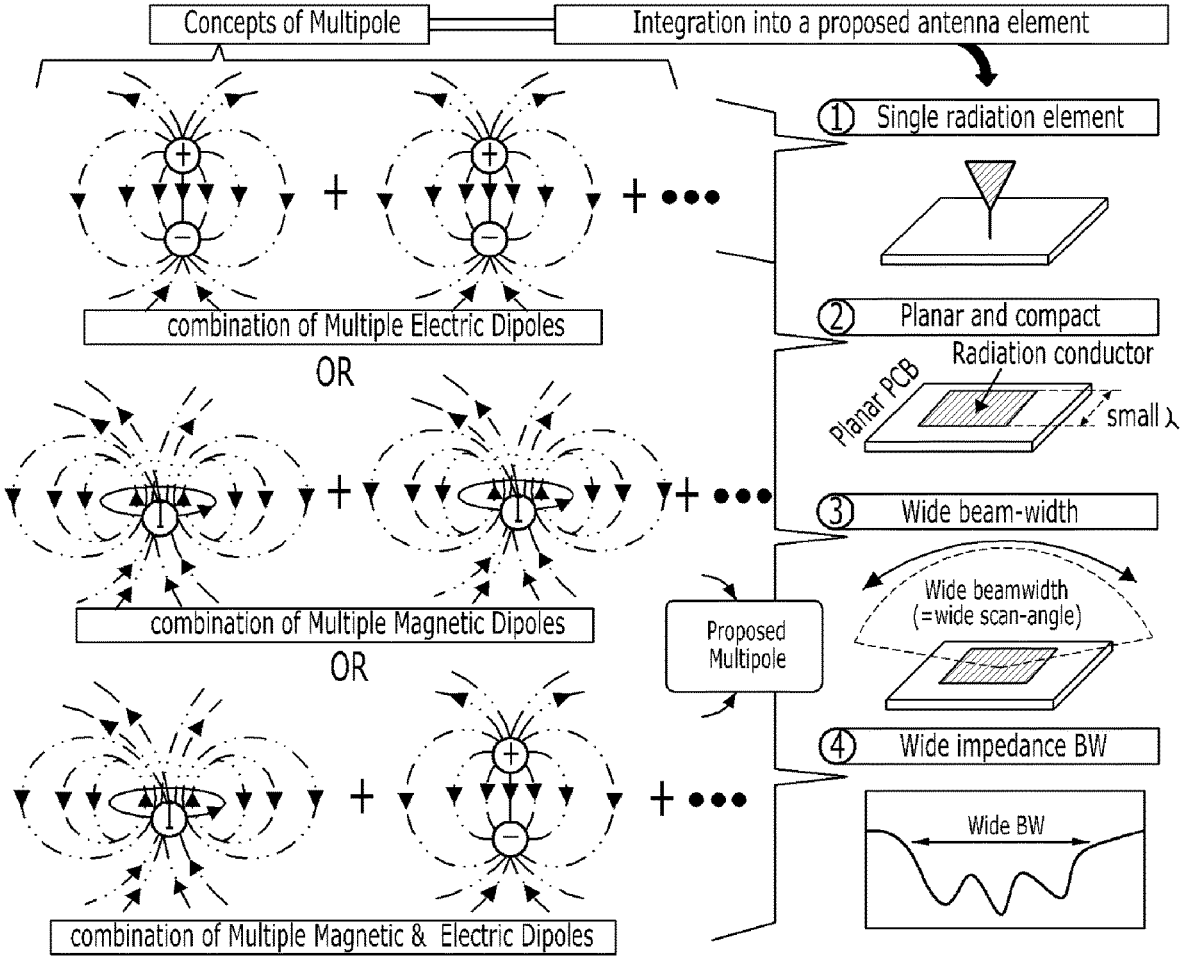
FIG. 6 is a view illustrating an effect of a planar multipole antenna according to an exemplary embodiment of the present disclosure.

FIG. 6 is a view illustrating an effect of a planar multipole antenna according to an exemplary embodiment of the present disclosure.

According to the present disclosure, a direction where the magnetic dipole is formed is adjusted by a direction of vias connected to the ground so that the antenna according to the present disclosure may widen a distribution range of the entire radiating field. That is, the antenna according to the present disclosure may achieve an effect that the beam width is increased in all directions.

According to the present disclosure, the plurality of reflectors is separately disposed on the conductor plate with a predetermined interval therebetween. When the reflectors are adjusted to have various sizes, a diversity is given to a resonant frequency so that a bandwidth of the entire radiator may be increased.

Figure 7A:
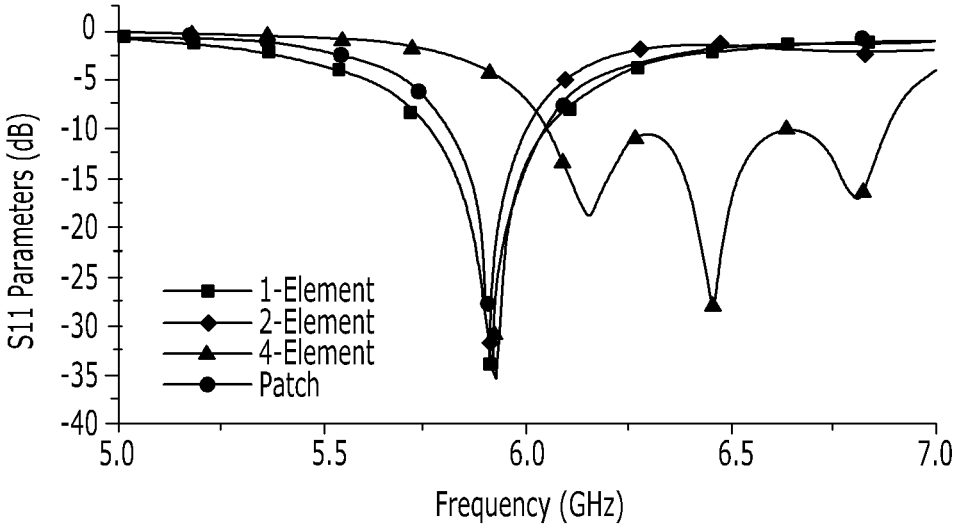
FIGS. 7A and 7B are graphs illustrating a bandwidth characteristic as an effect of a planar multipole antenna according to an exemplary embodiment of the present disclosure.
Figure 7B:
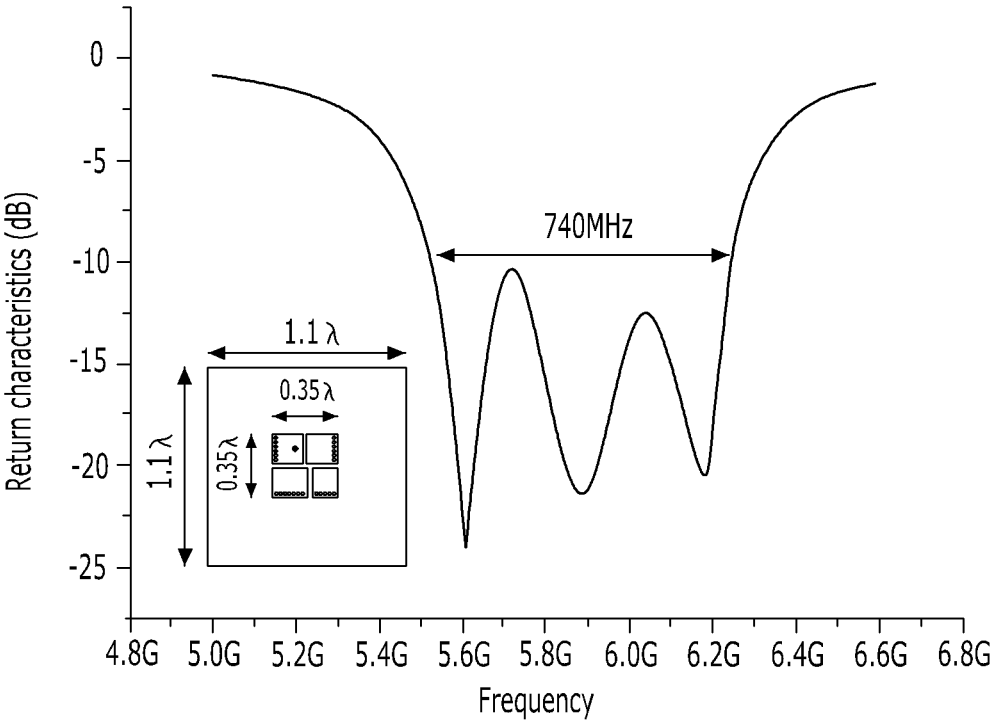

FIGS. 7A and 7B are graphs illustrating a bandwidth characteristic as an effect of a planar multipole antenna according to an exemplary embodiment of the present disclosure.

Referring to FIG. 7A, when the number of radiator elements is increased, specifically, four elements are used, the antenna resonance frequency is increased so that a bandwidth to be radiated is widened. When the resonance frequency is adjusted, the planar multipole antenna according to the exemplary embodiment of the present disclosure may form not only a broadband characteristic, but also a bandwidth characteristic such as a double band and a triple band. Therefore, various bandwidth characteristics may be formed by varying the number of radiator elements to be used.

Figure 5A:
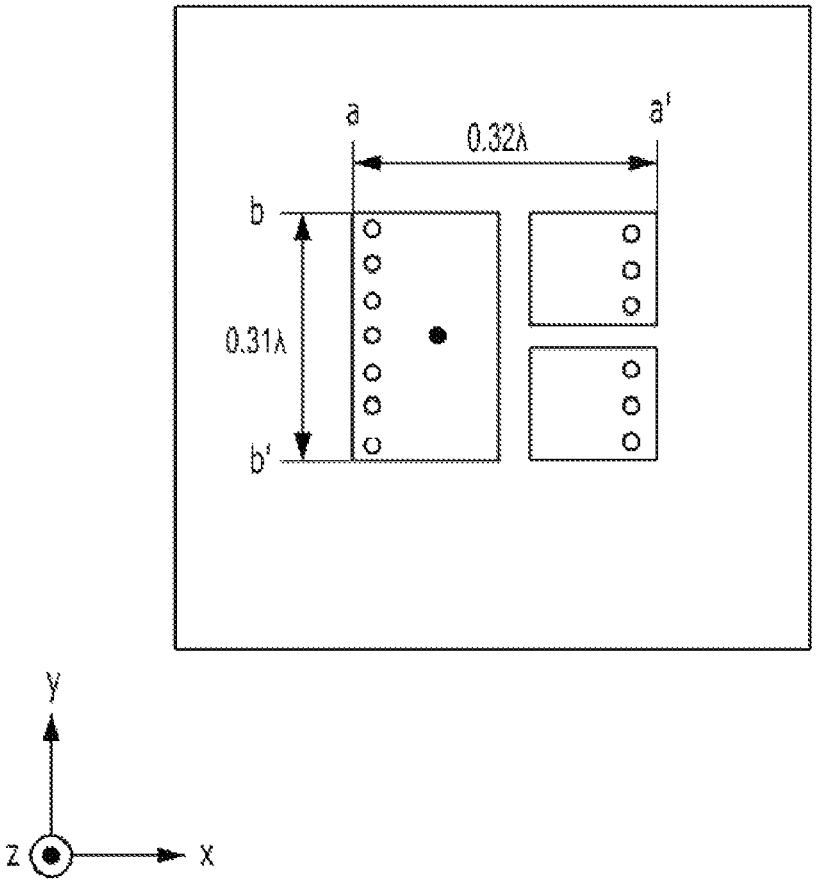
FIGS. 5A to 5L illustrate a structure and a size of a planar multipole antenna according to various exemplary embodiments of the present disclosure.
Figure 5B:
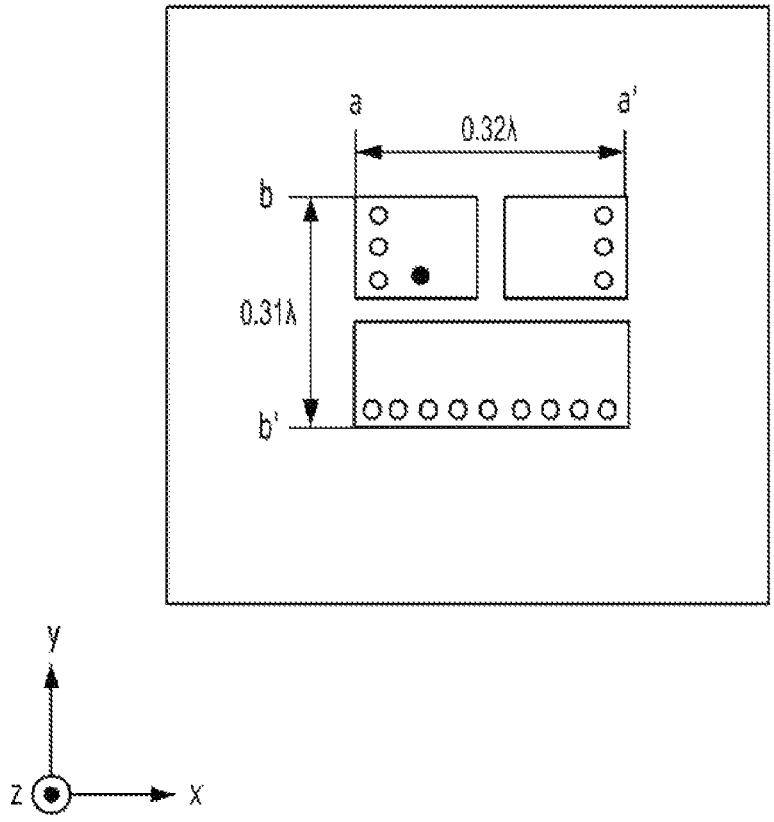
Figure 5C:
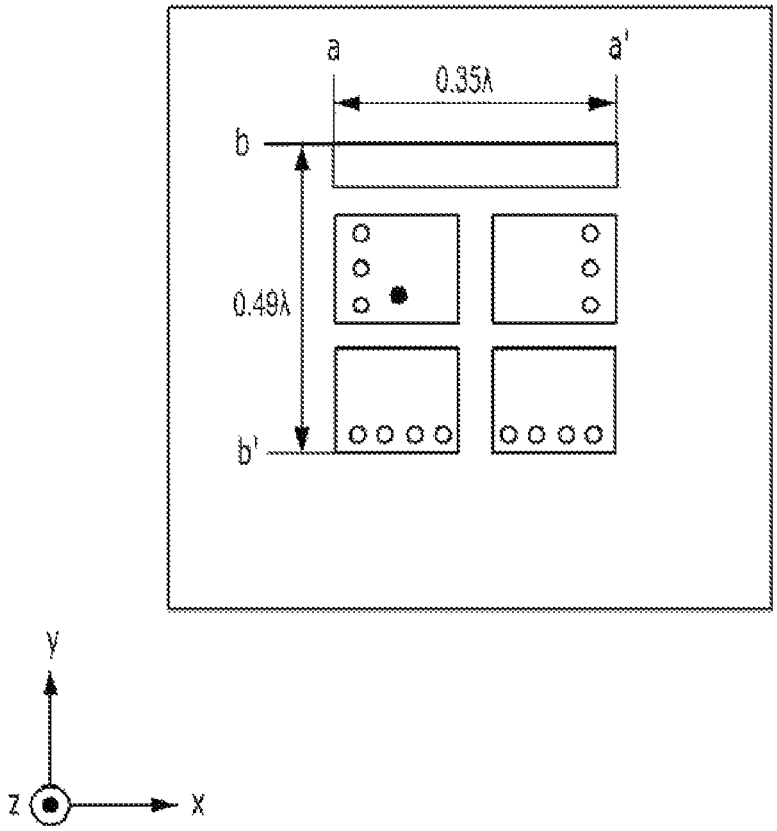
Figure 5D:
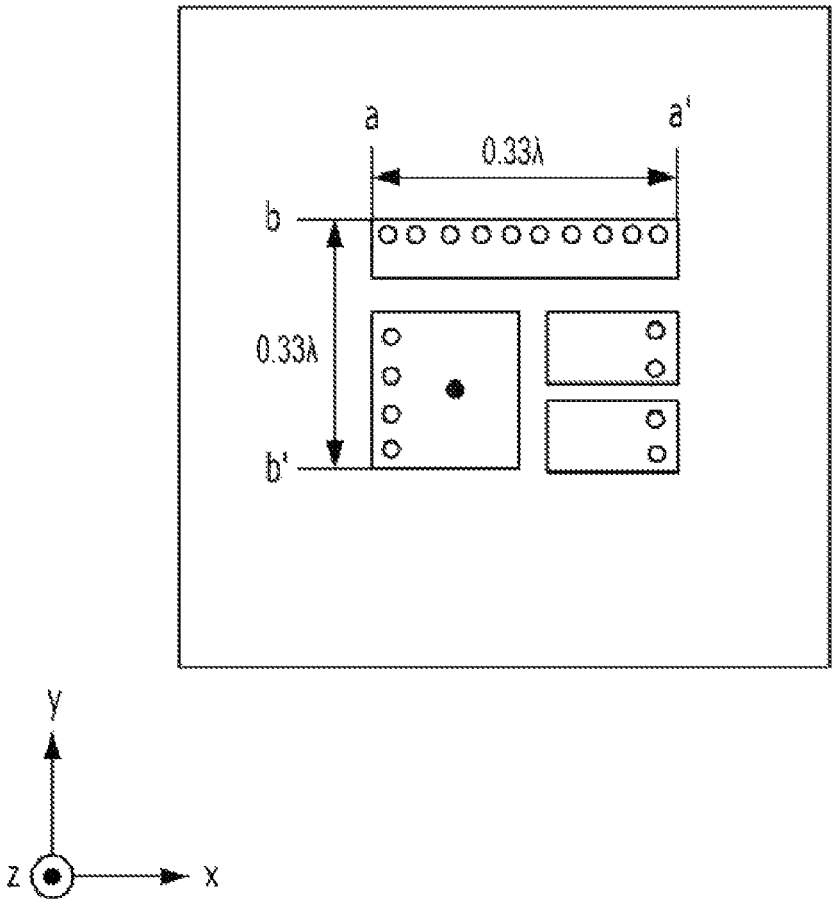
Figure 5E:
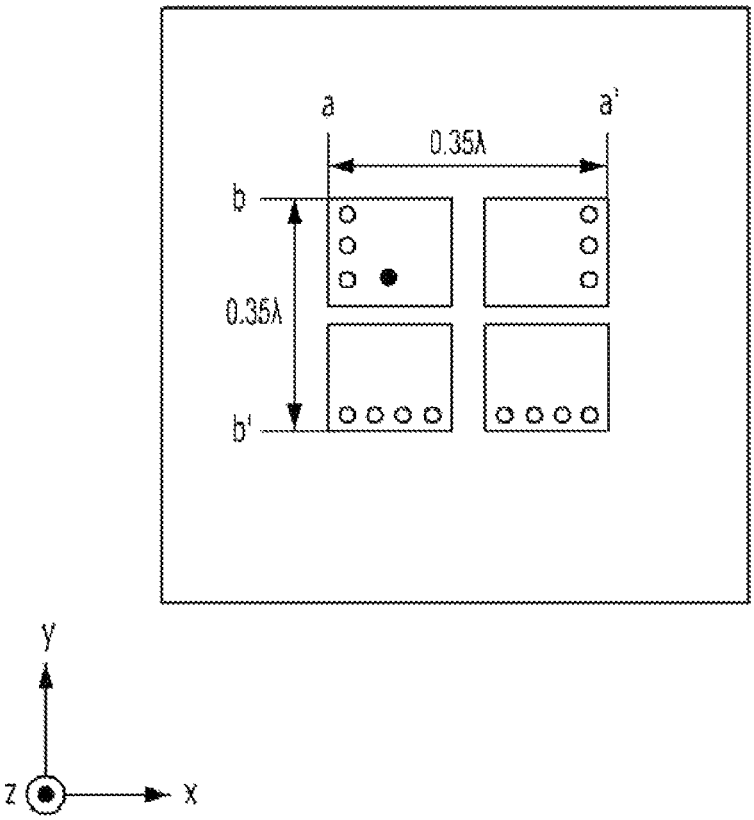
Figure 5F:
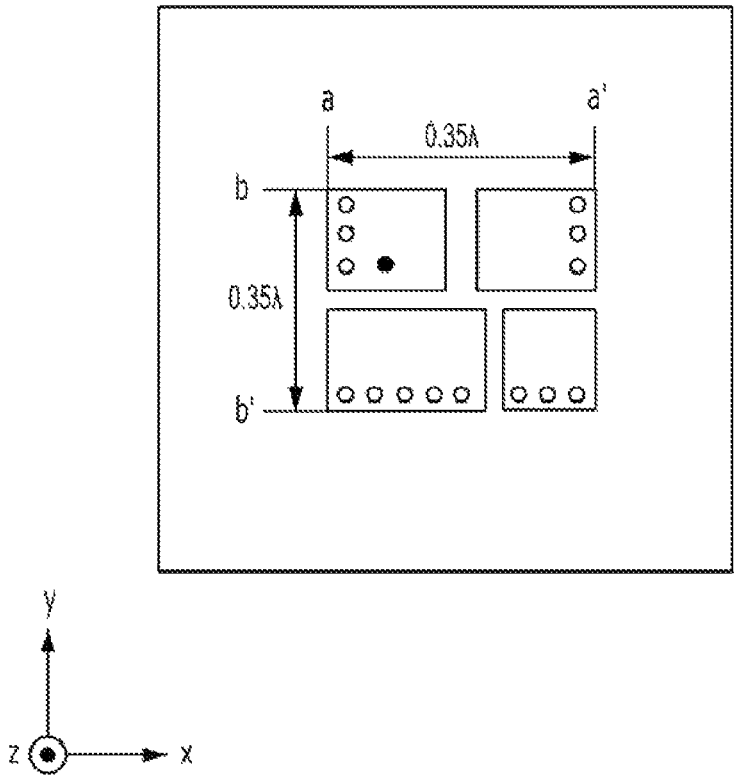
Figure 5G:
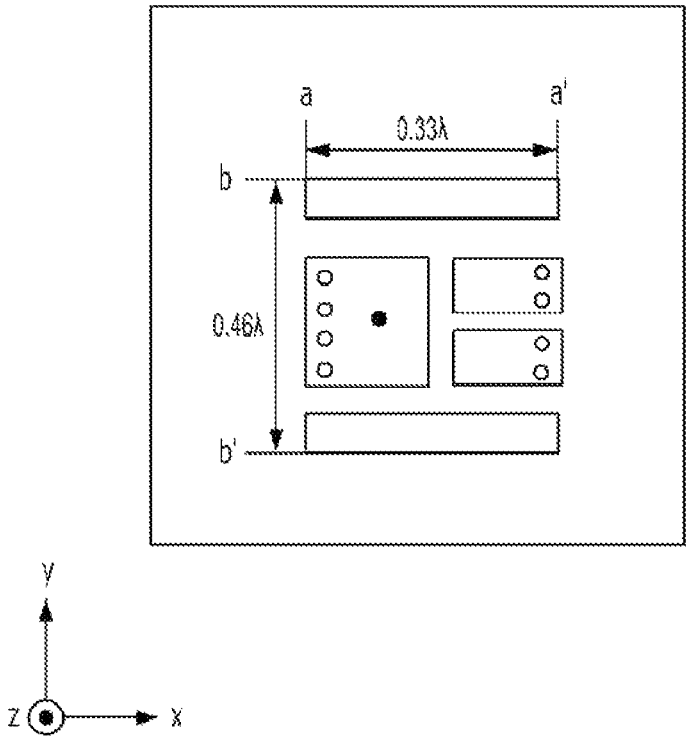
Figure 5H:
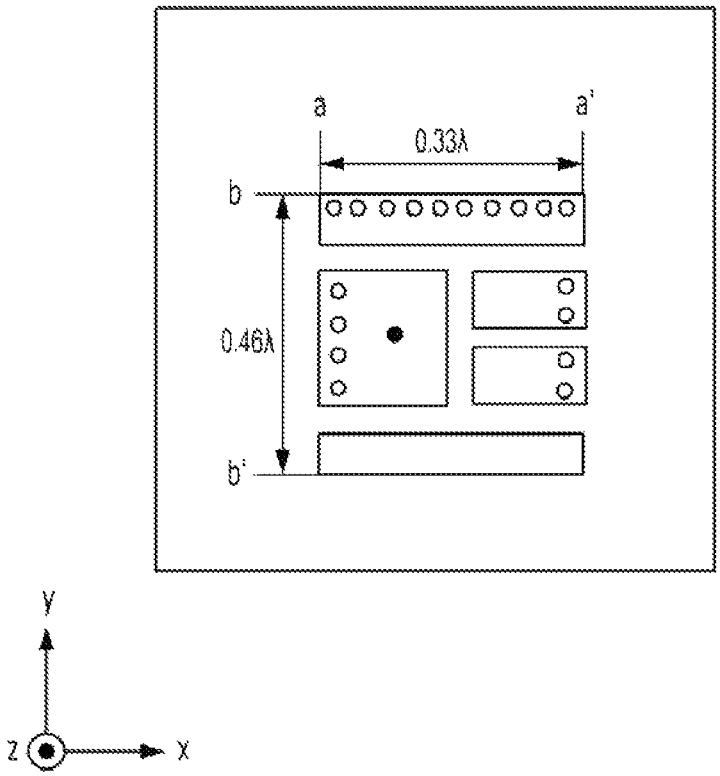

In the meantime, the result illustrated in FIG. 7B is a result obtained using a planar multipole antenna structure illustrated in FIG. 5F.

Referring to FIG. 7B, a small wide-angle antenna of the related art shows a bandwidth of approximately 200 MHz, but the antenna proposed by the present disclosure forms a bandwidth of 740 MHz or higher with a small size, which is different from the related art.

Figure 8:
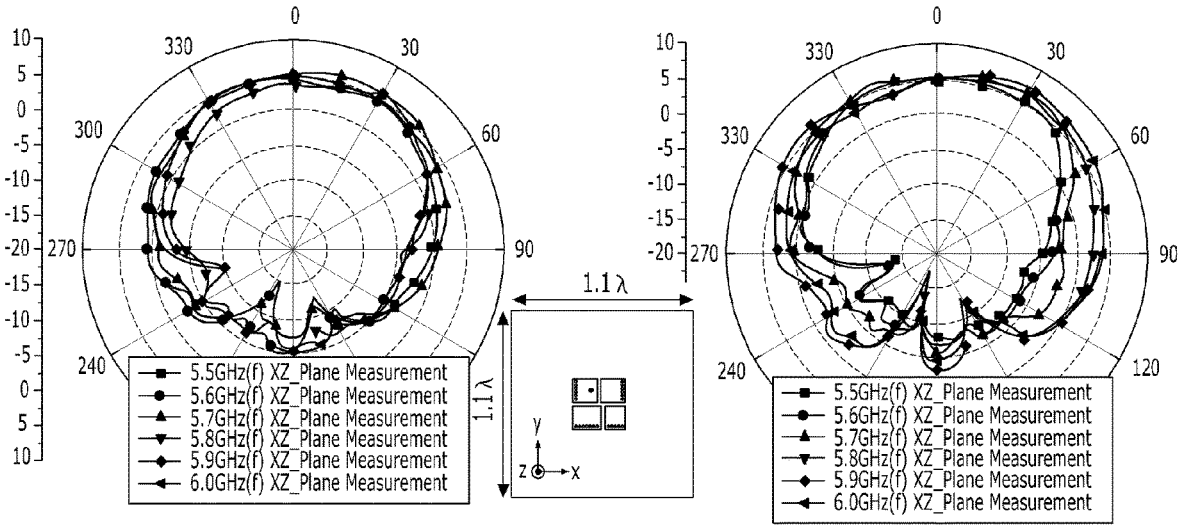
FIG. 8 is a graph illustrating a beamwidth characteristic as an effect of a planar multipole antenna according to an exemplary embodiment of the present disclosure.

FIG. 8 is a graph illustrating a beamwidth characteristic as an effect of a planar multipole antenna according to an exemplary embodiment of the present disclosure. More specifically, a left graph of FIG. 8 illustrates a radiation pattern for an XZ cross section and a right graph of FIG. 8 illustrates a radiation pattern for a YZ cross section.

TABLE 1

| Freq. (GHz) | Measured Gain | HPBW |
|---|---|---|
| 5.5 | xz plane: 4.76 dBi | xz plane: 139° |
| | yz plane: 4.49 dBi | yz plane: 110° |
| 5.6 | xz plane: 5.49 dBi | xz plane: 141° |
| | yz plane: 5.11 dBi | yz plane: 110° |
| 5.7 | xz plane: 5.44 dBi | xz plane: 111° |
| | yz plane: 5.4 dBi | yz plane: 119° |
| 5.8 | xz plane: 5.17 dBi | xz plane: 96° |
| | yz plane: 5.64 dBi | yz plane: 152° |
| 5.9 | xz plane: 5.31 dBi | xz plane: 111° |
| | yz plane: 6.35 dBi | yz plane: 160° |
| 6.0 | xz plane: 4.71 dBi | xz plane: 116° |
| | yz plane: 6.15 dBi | yz plane: 144° |

Referring to FIG. 8 and Table 1, it is understood that there is no large change in an antenna gain over a wide band and the beam width is widened for all planes above the antenna.

The larger the ground size, the wider the beam width. However, in the exemplary embodiment of the present disclosure, a ground with a size of 1.1λ is used. The beam width is larger in all directions within the ground size, as compared with the antennas of the related art.

That is, a larger beamwidth may be formed for all planes in a small ground size as compared with structures of the related art.

Additionally, in the wide angle antenna of the related art, the beam width is relatively widened only for one plane with a finite ground size with respect to the antenna, but in the planar multipole antenna according to the present disclosure, the beam width is widened for both planes with a smaller ground size, which is different from the antenna of the related art.

Further, even though a ground size is increased, in the antenna of the related art, the beamwidth is increased only on one plane. However, according to the planar multipole antenna structure according to the present disclosure, when the ground size is increased, beamwidths of all planes are increased, which is also different from the antenna of the related art.

Accordingly, according to the exemplary embodiment of the present disclosure, the three-dimensional beam forming antenna in which a shadow region is not generated can be configured.

Figure 9:
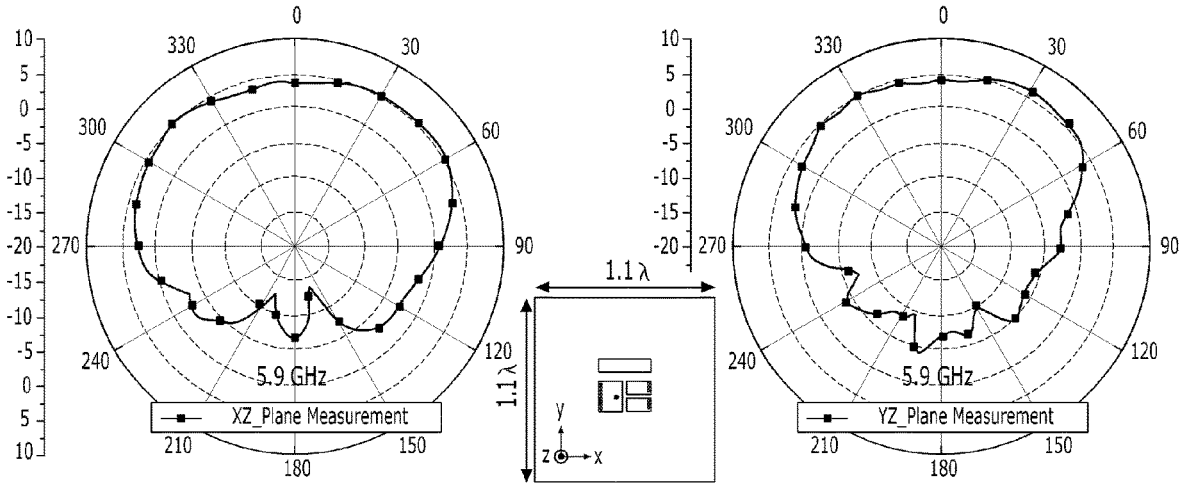
FIG. 9 is a graph illustrating a beamwidth characteristic as an effect of a planar multipole antenna according to another exemplary embodiment of the present disclosure.

FIG. 9 is a graph illustrating a beamwidth characteristic as an effect of a planar multipole antenna according to another exemplary embodiment of the present disclosure. More specifically, a left graph of FIG. 9 illustrates a radiation pattern for an XZ cross section and a right graph of FIG. 9 illustrates a radiation pattern for a YZ cross section.

Figure 5I:
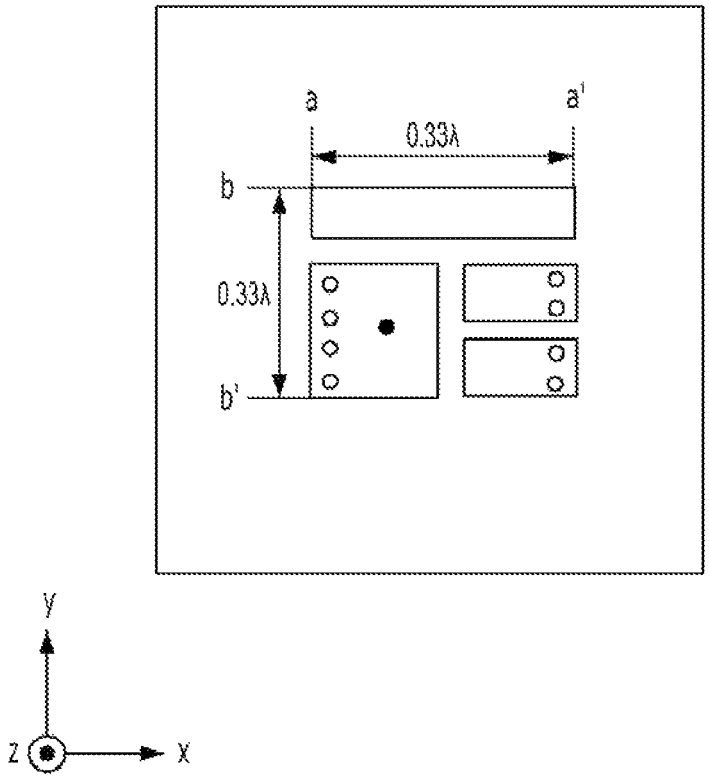

The result illustrated in FIG. 9 and Table 2 is a result obtained using a planar multipole antenna structure illustrated in FIG. 5I.

TABLE 2

| Freq. (GHz) | Measured Gain | HPBW |
|---|---|---|
| 5.9 | xz plane: 5.3 dBi<br>yz plane: 4.94 dBi | xz plane: 175°<br>yz plane: 133° |

Figure 10:
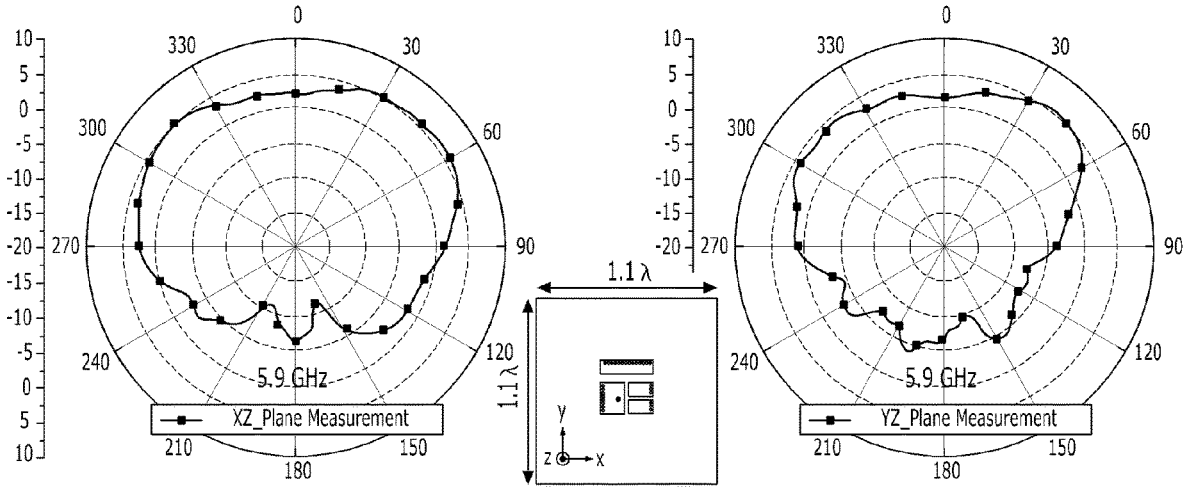
FIG. 10 is a graph illustrating formation of various beams as an effect of a planar multipole antenna according to still another exemplary embodiment of the present disclosure.

FIG. 10 is a graph illustrating formation of various beams as an effect of a planar multipole antenna according to still another exemplary embodiment of the present disclosure. More specifically, a left graph of FIG. 10 illustrates a radiation pattern for an XZ cross section and a right graph of FIG. 10 illustrates a radiation pattern for a YZ cross section.

Figure 5J:
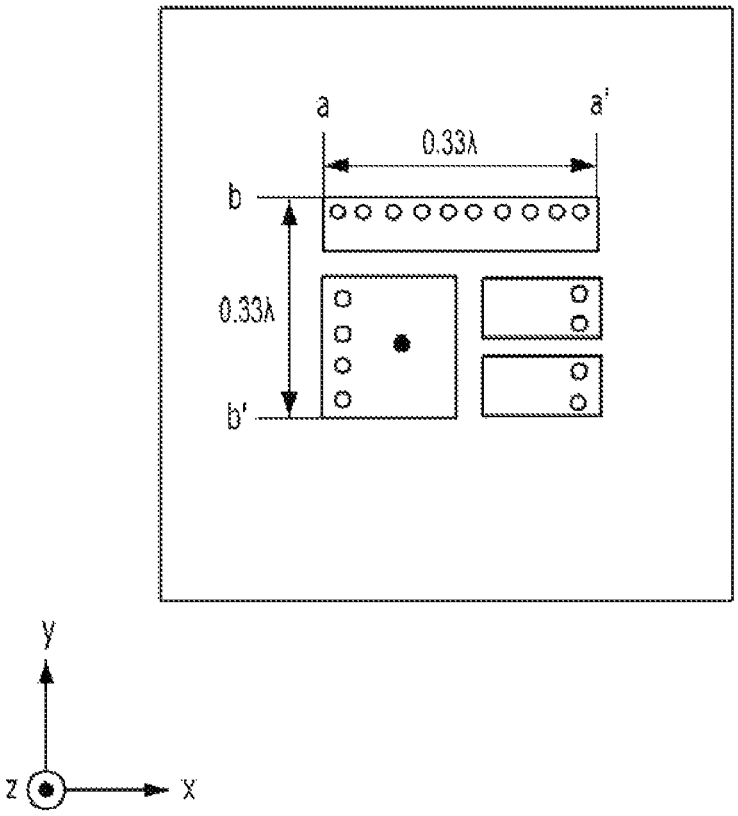
Figure 5K:
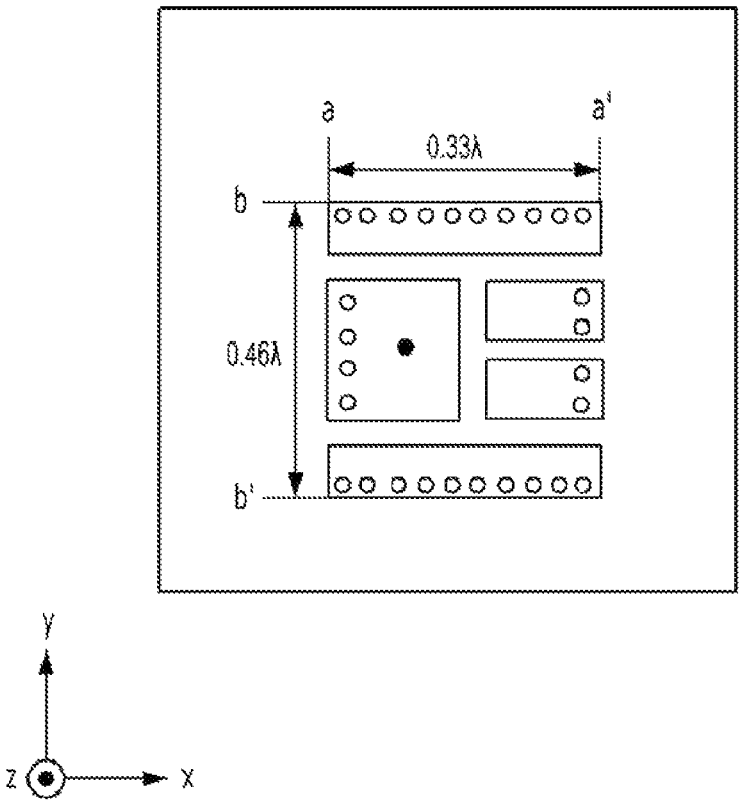
Figure 5L:
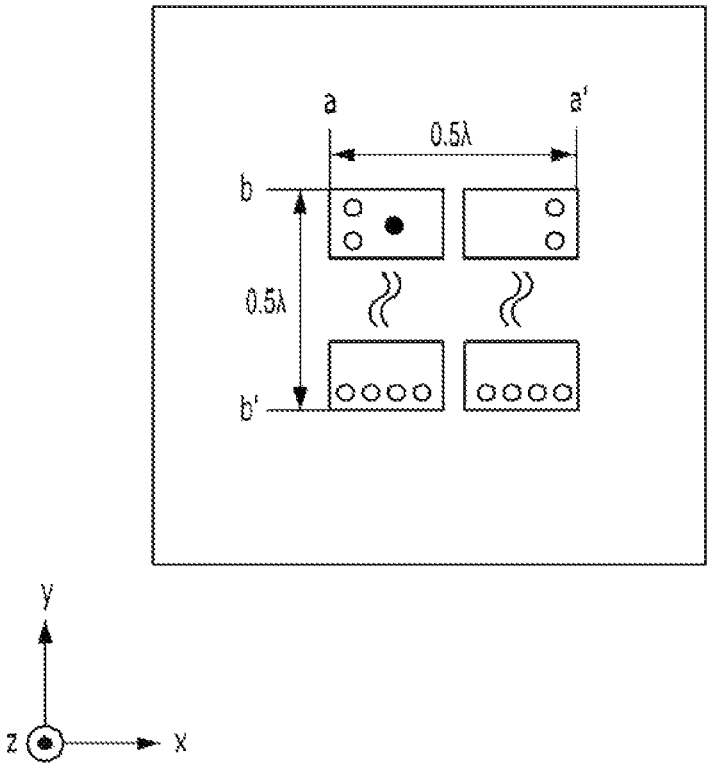

The result illustrated in FIG. 10 and Table 3 is a result obtained using a planar multipole antenna structure illustrated in FIG. 5J.

TABLE 3

| Freq. (GHz) | Measured Gain | HPBW |
|---|---|---|
| 5.9 | xz plane: 5.46 dBi<br>yz plane: 5.57 dBi | xz plane: 170°<br>yz plane: 130° |

Referring to FIGS. 9 and 10, when the antenna structure is modified in accordance with another exemplary embodiment of the present disclosure, even though the band width may be sacrificed, there is an advantage in that the beam width for all planes may be formed to be larger with the same ground size.

Figure 11A:
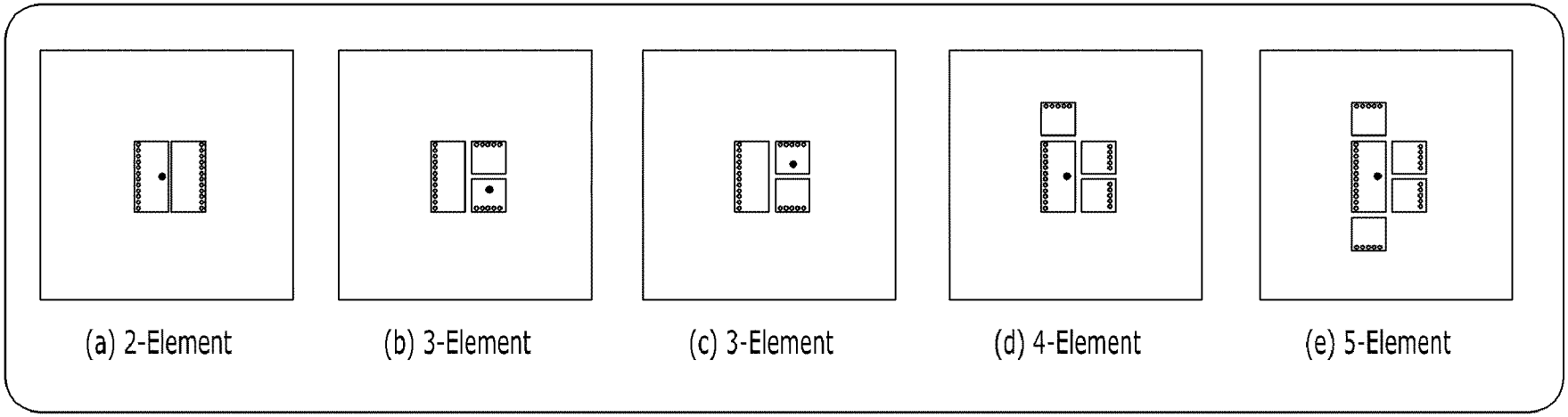
FIGS. 11A and 11B illustrate formation of various beam shapes as an effect of a planar multipole antenna according to various exemplary embodiments of the present disclosure.
Figure 11B:
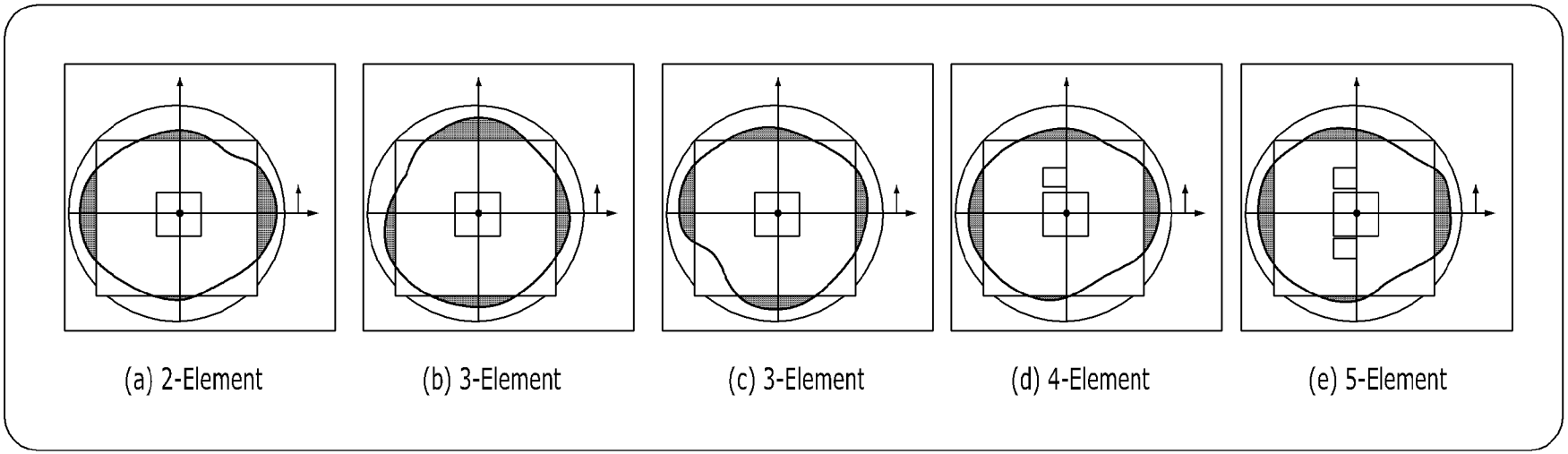

FIGS. 11A and 11B illustrate formation of various beam shapes as an effect of a planar multipole antenna according to various exemplary embodiments of the present disclosure. Results for antenna structures illustrated in (a), (b), (c), (d), and (e) of FIG. 11A match beam shapes illustrated in (a), (b), (c), (d), and (e) of FIG. 11B.

Referring to FIGS. 11A and 11B, it is confirmed that the planar multipole antenna has various structures according to the exemplary embodiment of the present disclosure so that the beams to be formed may have various shapes. Therefore, according to the present disclosure, there is an advantage in that the antenna beam may be formed to have various shapes.

Figure 12A:
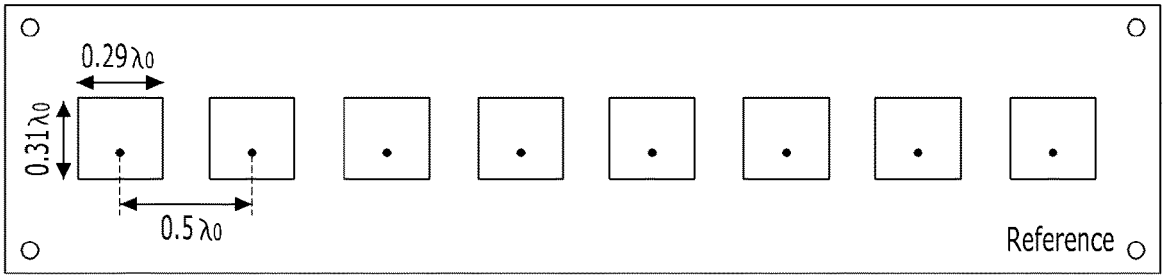
FIGS. 12A to 12C are views a 1×8 array configuration of a planar multipole antenna according to various exemplary embodiments of the present disclosure.
Figure 12B:
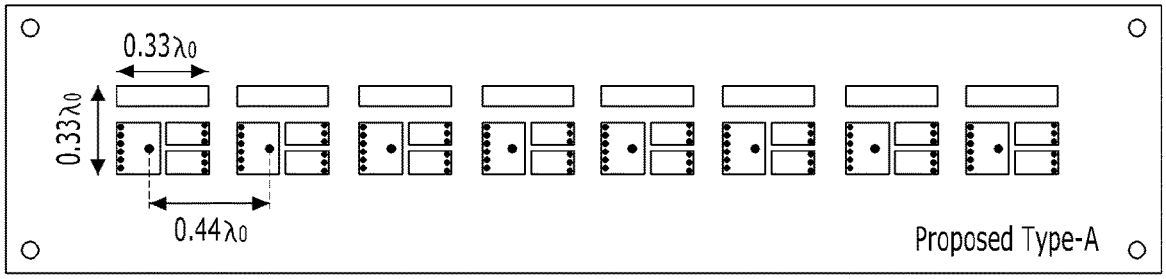
Figure 12C:
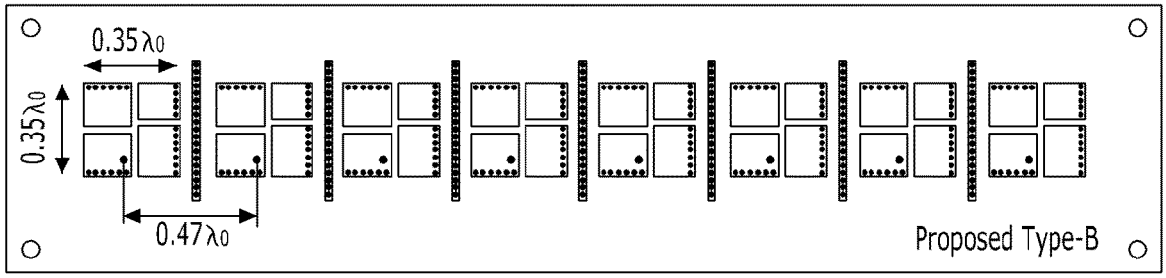
Figure 13A:
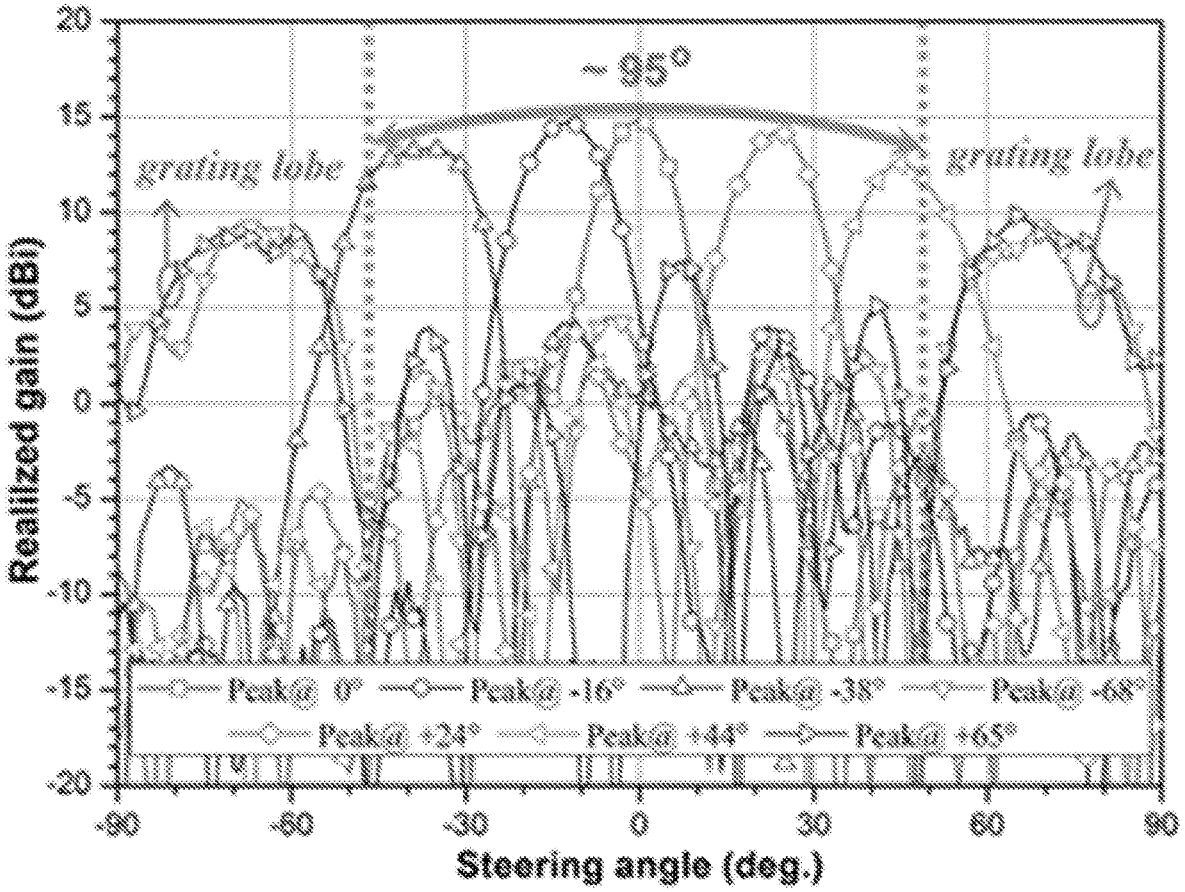
FIGS. 13A to 13C are graphs obtained by measuring a scan angle by FIGS. 12A to 12C.
Figure 13B:
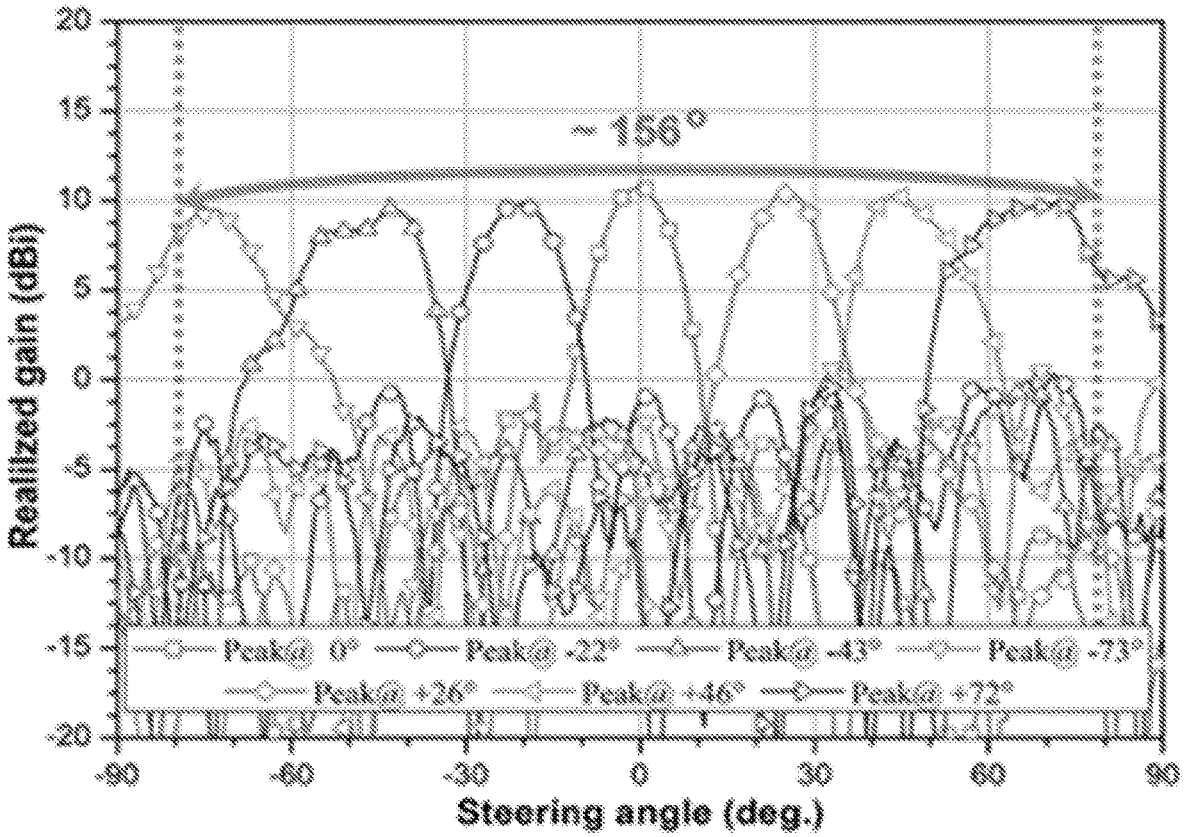
Figure 13C:
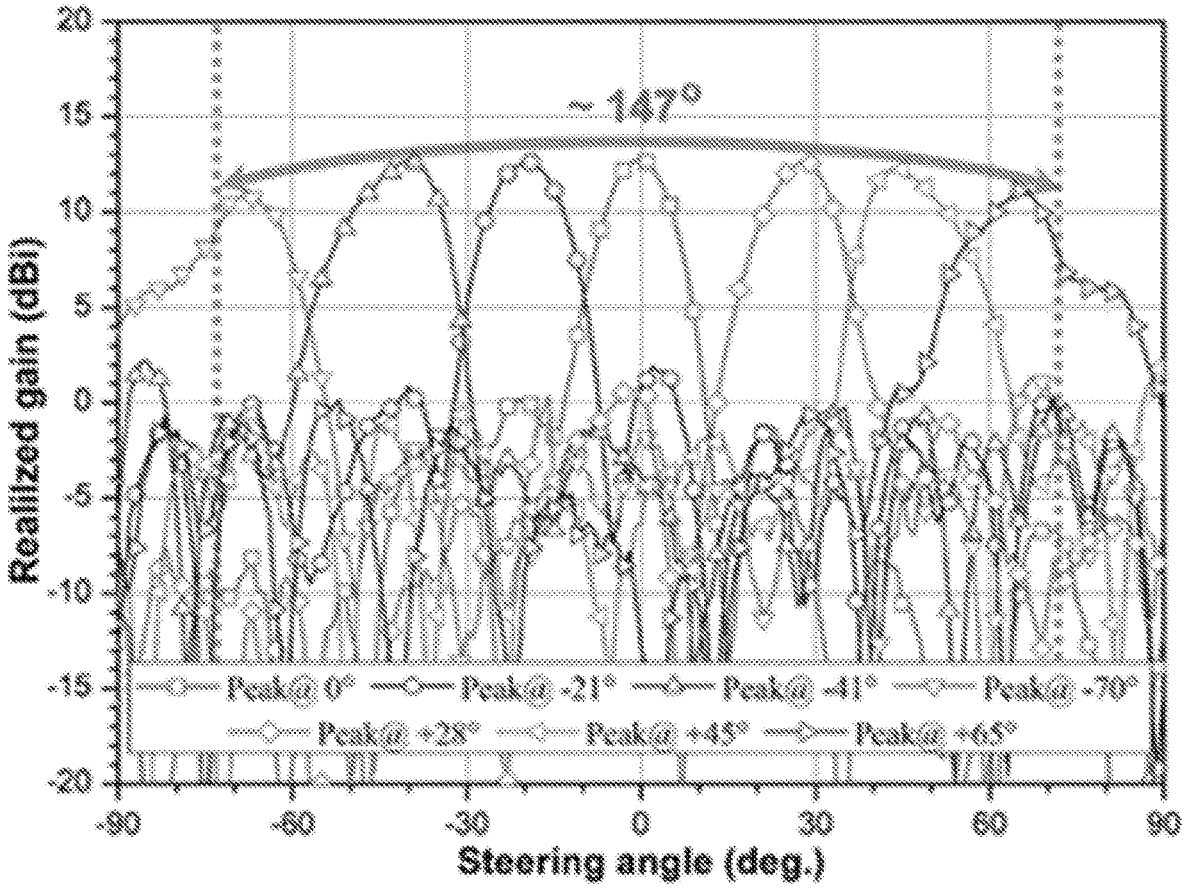

FIGS. 12A to 12C are views a 1×8 array configuration of a planar multipole antenna according to various exemplary embodiments of the present disclosure, and FIGS. 13A to 13C are graphs obtained by measuring a scan angle by FIGS. 12A to 12C.

Referring to FIGS. 12A to 12C, FIG. 12A illustrates a 1×8 array configuration manufactured using a general patch. Referring to FIGS. 12B and 12C, at least one radiator may be configured. FIGS. 12A to 12C are views illustrating a 1×8 array configuration using a multipole element.

Referring to FIGS. 13A to 13C, in FIG. 13A, when an antenna with a 1×8 array configuration was manufactured using a general patch of FIG. 12A, a scan angle was approximately 95°. In contrast, as illustrated in FIGS. 13B and 13C, when an antenna with a 1×8 array configuration was manufactured using a multipole element, scan angles of approximately 1560 and approximately 1470 were measured. That is, it is confirmed that when the antenna is configured by a multipole element, a beam steering angle may be widened.

Figure 14:
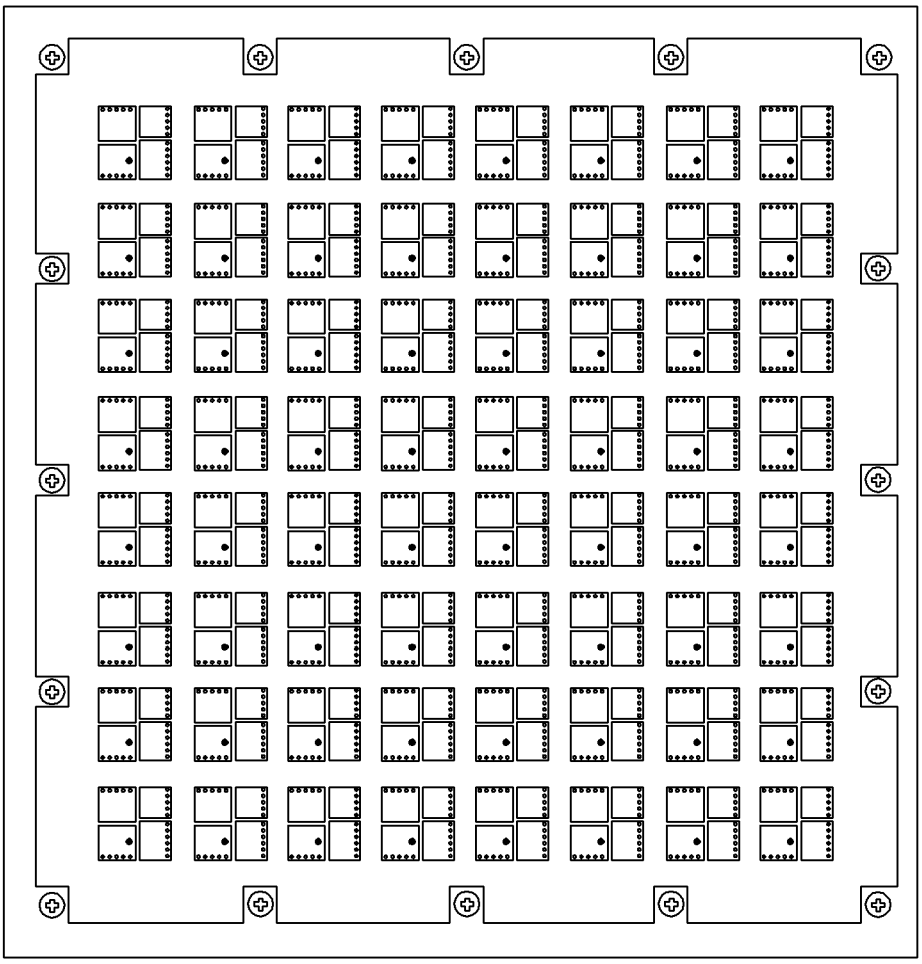
FIG. 14 is a view illustrating an 8×8 array configuration of a planar multipole antenna according to an exemplary embodiment of the present disclosure.

FIG. 14 is a view illustrating an 8×8 array configuration of a planar multipole antenna according to an exemplary embodiment of the present disclosure.

Referring to FIG. 14, the multipole antenna is manufactured with an 8×8 array configuration, but is not limited thereto, and an M×N array configuration is used to achieve a wider beam steering angle for all directions.

It will be appreciated that various exemplary embodiments of the present invention have been described herein for purposes of illustration, and that various modifications, changes, and substitutions may be made by those skilled in the art without departing from the scope and spirit of the present invention. Therefore, the exemplary embodiments of the present disclosure are provided for illustrative purposes only but not intended to limit the technical concept of the present disclosure. The scope of the technical concept of the present disclosure is not limited thereto. The protective scope of the present disclosure should be construed based on the following claims, and all the technical concepts in the equivalent scope thereof should be construed as falling within the scope of the present disclosure.

What is claimed is:

1. A planar multipole antenna, comprising:

a plurality of radiators formed above a conductor plate, wherein the plurality of radiator includes a main radiator and a plurality of additional radiators, the main radiator includes a signal applying hole to which a signal is applied, and the additional radiator is connected to a ground formed on the conductor plate.

2. The planar multipole antenna according to claim 1, wherein the main radiator forms a magnetic dipole or an electric dipole, and the additional radiators induce a magnetic dipole or an electric dipole by the main radiator.

3. The planar multipole antenna according to claim 1, wherein the main radiator further includes a plurality of via holes, the additional radiators are connected to the ground formed on the conductor plate through a plurality of via holes formed in the additional radiators, and when the plurality of via holes formed in the main radiator forms a column in a first direction, the plurality of via holes formed in the additional radiators forms a column in a second direction.

4. The planar multipole antenna according to claim 3, wherein the plurality of via holes is formed in a line.

5. The planar multipole antenna according to claim 3, wherein the plurality of via holes is formed at one end of the radiator.

6. The planar multipole antenna according to claim 3, wherein when the plurality of radiators forms a plurality of columns in the first direction, the plurality of via holes is formed in a line in the second direction.

7. The planar multipole antenna according to claim 3, wherein when the plurality of radiators forms a plurality of columns in the second direction, the plurality of via holes included in a radiator disposed in at least one column is formed in a line in the first direction.

8. The planar multipole antenna according to claim 3, wherein when a single radiator is disposed in the first direction, a plurality of via holes included in the single radiator is formed in a line in the first direction.

9. The planar multipole antenna according to claim 3, wherein when a single radiator is disposed in the second direction, a plurality of via holes included in the single radiator is formed in a line in the second direction.

10. The planar multipole antenna according to claim 1, wherein in a position of the plurality of radiators disposed on the conductor plate, a distance from one surface of a radiator located at one end in the first direction to the other surface of a radiator located at the other end in the first direction is 0.5λ (half wavelength) or less, and a distance from one surface of a radiator located at one end in the second direction to the other surface of a radiator located at the other end in the second direction is 0.5λ (half wavelength) or less.

* * * * *